US011207226B2

(12) United States Patent
Steinbock

(10) Patent No.: US 11,207,226 B2
(45) Date of Patent: Dec. 28, 2021

(54) LIGHTWEIGHT HUMAN TRANSPORT DEVICE

(71) Applicant: MATBOCK LLC, Virginia Beach, VA (US)

(72) Inventor: Zach Steinbock, Virginia Beach, VA (US)

(73) Assignee: Matbock LLC, Virginia Beach, VA (US)

( * ) Notice: Subject to any disclaimer, the term of this patent is extended or adjusted under 35 U.S.C. 154(b) by 219 days.

(21) Appl. No.: 16/253,518

(22) Filed: Jan. 22, 2019

(65) Prior Publication Data

US 2020/0229996 A1 Jul. 23, 2020

(51) Int. Cl.

| | |
|---|---|
| ***A61G 1/013*** | (2006.01) |
| ***A61G 1/01*** | (2006.01) |
| ***A61G 1/044*** | (2006.01) |

(52) U.S. Cl.

CPC ..... *A61G 1/013* (2013.01); *A61G 1/01* (2013.01); *A61G 1/044* (2013.01)

(58) Field of Classification Search

CPC ..... A61G 1/01; A61G 1/013; A61G 1/044; A61G 1/048

See application file for complete search history.

(56) References Cited

U.S. PATENT DOCUMENTS

| | | | | |
|---|---|---|---|---|
| 7,810,820 | B2 | 10/2010 | Wolf et al. | |
| 7,865,986 | B2 | 1/2011 | Smart | |
| 8,590,077 | B2 * | 11/2013 | Saunders | A61G 1/003 5/628 |
| 8,793,827 | B1 | 8/2014 | Smart et al. | |
| 9,198,812 | B2 | 12/2015 | Smart et al. | |
| D874,732 | S * | 2/2020 | Smart | A61G 7/1051 D29/101.4 |
| 2004/0088794 | A1 * | 5/2004 | Calkin | A61G 1/01 5/628 |
| 2007/0136950 | A1 * | 6/2007 | Zuercher | A47G 9/086 5/627 |
| 2009/0236380 | A1 | 9/2009 | Adkins | |
| 2010/0005593 | A1 * | 1/2010 | Bowling | A61G 1/044 5/627 |
| 2018/0271723 | A1 | 9/2018 | Adkins | |
| 2020/0000654 | A1 * | 1/2020 | Smart | A61G 1/044 |

FOREIGN PATENT DOCUMENTS

EP 2303210 B1 10/2014

* cited by examiner

*Primary Examiner* — Eric J Kurilla
(74) *Attorney, Agent, or Firm* — Stinson LLP

(57) ABSTRACT

A compact, portable sled for transporting a person comprises a flexible panel, sheet portions and strapping. The flexible panel has head and foot portions, first and second sides, a sled length, and a sled width. The flexible panel is constructed of a wear resistant material for dragging over rough terrain. The sheet portions made of limp material that is less resistant to wear than the flexible panel. One sheet portion is attached to and extends laterally outward from the first side of the flexible panel. Another sheet portion is attached to and extends laterally outward from the second side of the flexible panel. The flexible panel and sheet portions are collapsible to a compact configuration and expandable from the compact configuration to a use configuration in which the person may be received on the sled for transporting. The strapping is used to secure the person in the sled.

24 Claims, 9 Drawing Sheets

LIGHTWEIGHT HUMAN TRANSPORT DEVICE

FIELD OF THE INVENTION

The present disclosure generally relates to human transport devices, and more particularly to lightweight human transport devices for use by military or rescue personnel to transport an injured person.

BACKGROUND OF THE INVENTION

In an emergency situation, an immobilized person needs to be quickly evacuated from the emergency site. Responders to these emergencies need to be able to transport the immobilized person from the site to a care facility or a location where the responders can administer treatment. These responders may include military personnel, medical personnel, search and rescue personnel, police officers, firefighters, emergency medical technicians, and/or other emergency personnel. A common way to transport an immobilized person is with a stretcher. There are a number of different stretchers currently employed by emergency personnel. For example, an immobilized person may be placed in a fabric or basket type stretcher and hoisted or otherwise transported by emergency personnel from the emergency site.

SUMMARY

In one aspect, a compact, portable sled for transporting a person comprises a flexible panel having a head portion, a foot portion, a first side and a second side, a sled length extending from the head portion to the foot portion, and a sled width extending from the first side to the second side. The first and second sides extend from the head portion toward the foot portion. The flexible panel is constructed of a wear resistant material for dragging over rough terrain. The sled also comprises sheet portions made of limp material that is less resistant to wear than the material of the flexible panel. The sheet portions are attached to the flexible panel with one of the sheet portions extending laterally outwardly from the first side of the flexible panel and another sheet portion extending laterally outwardly from the second side of the flexible panel. The flexible panel and sheet portions are collapsible to a compact configuration and expandable from the compact configuration to a use configuration in which the person may be received on the sled for transporting. The sled also includes strapping to secure the person in the sled.

BRIEF DESCRIPTION OF THE DRAWINGS

Corresponding reference characters indicate corresponding parts throughout the drawings.

DETAILED DESCRIPTION

Figure 1:
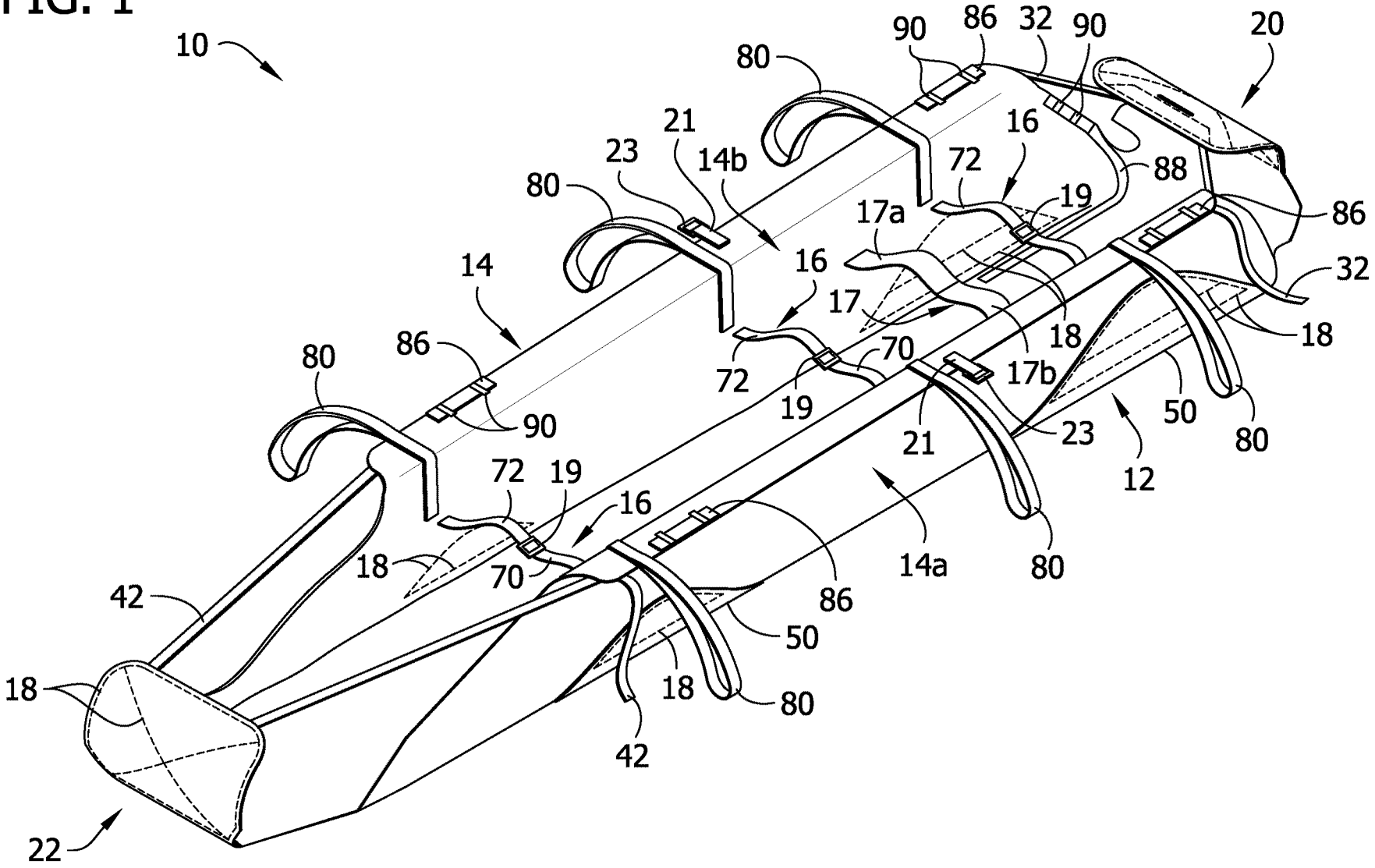
FIG. 1 is a perspective of the human transport sled of the present disclosure.

As shown in FIG. 1, a human transport device of the current disclosure is generally indicated by the reference number 10. The transport device 10 is shown in FIG. 1 in a configuration that it would have when carrying a person. As described more fully hereinafter, the transport device 10 is lightweight and can be rolled up into a size which permits it to be easily carried by a person into environments where vehicles cannot readily traverse. However, the ability to be stored in a compact configuration also permits the transport device to be stored near, for example, a patient in a hospital without occupying significant valuable floor space. When there is a medical emergency that occurs in an environment that does not permit the ready use of a conventional stretcher, it important to be able to evacuate an immobilized injured person from the environment. Some examples of the type of environment where the transport device would have application are on a battlefield or in a hospital near the patient for rapid evacuation such as during a fire or earthquake. As will become apparent, the transport device 10 of the present disclosure can be used in various ways to evacuate an immobilized person from environments where a conventional stretcher is not readily available and not easily employed.

Figure 8:
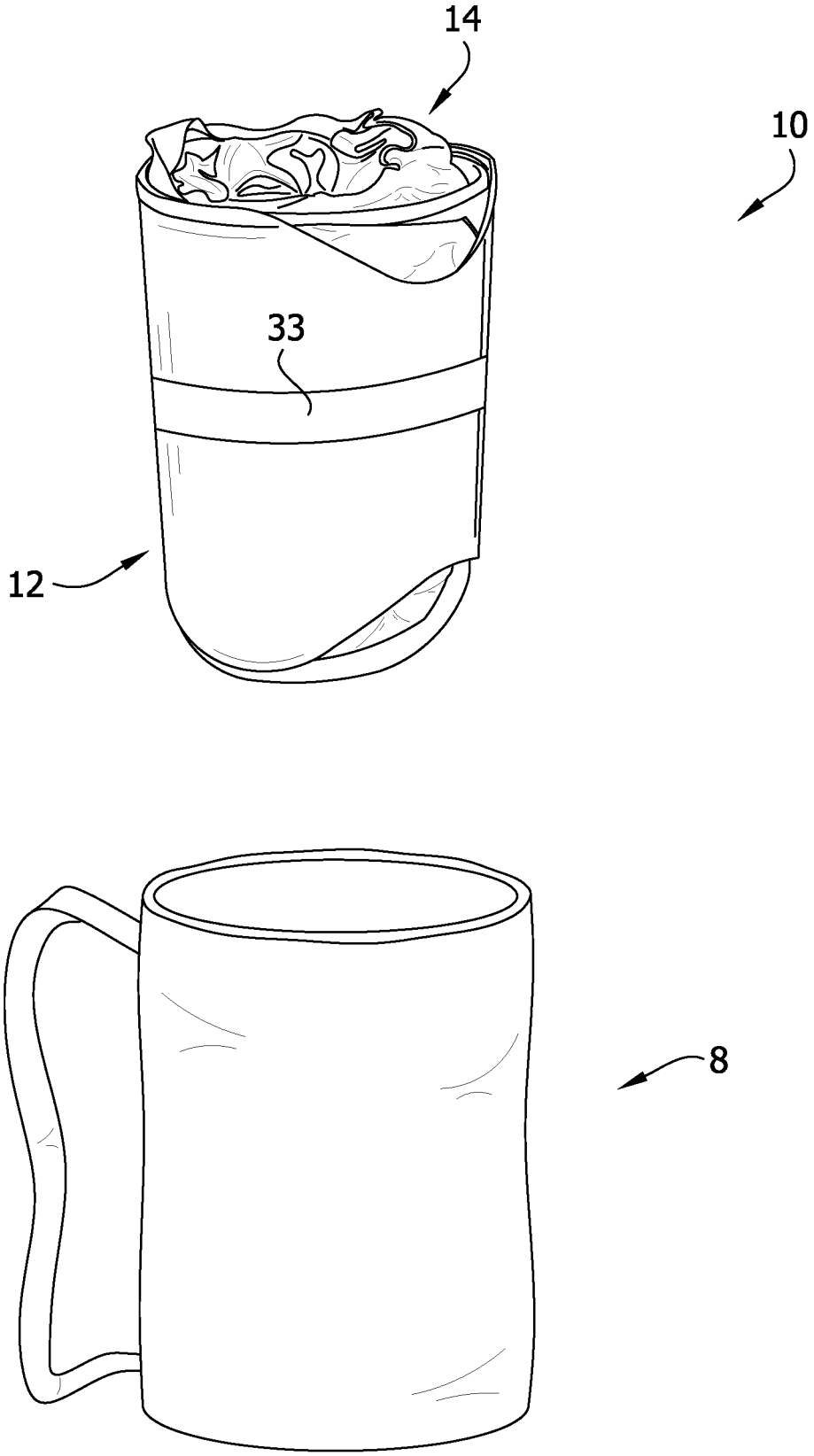
FIG. 8 is a perspective of the sled in a stowed configuration, and a carry bag therefor.

The transport device 10 generally includes a flexible panel 12, a sheet 14, and a plurality of straps assemblies (e.g., strapping) for use with the device, such as harness strap assemblies 16 configured to secure the person to the device. With a person secured to the transport device 10, the transport device can be transported in a number of different ways, as will be described in greater detail below. The transport device 10 is configurable in a stowed configuration, such as shown in FIG. 8, in which the transport device is rolled into a compact cylinder-like shape and can be conveniently stored in a bag or a backpack 8. The transportation device 10 is configured to be light-weight and, preferably, weighs no more than 5 lbs. (2.3 kg). The transport device 10 of the illustrated embodiment will hereinafter be referred to as a "sled," for reasons which will become apparent.

Figure 2:
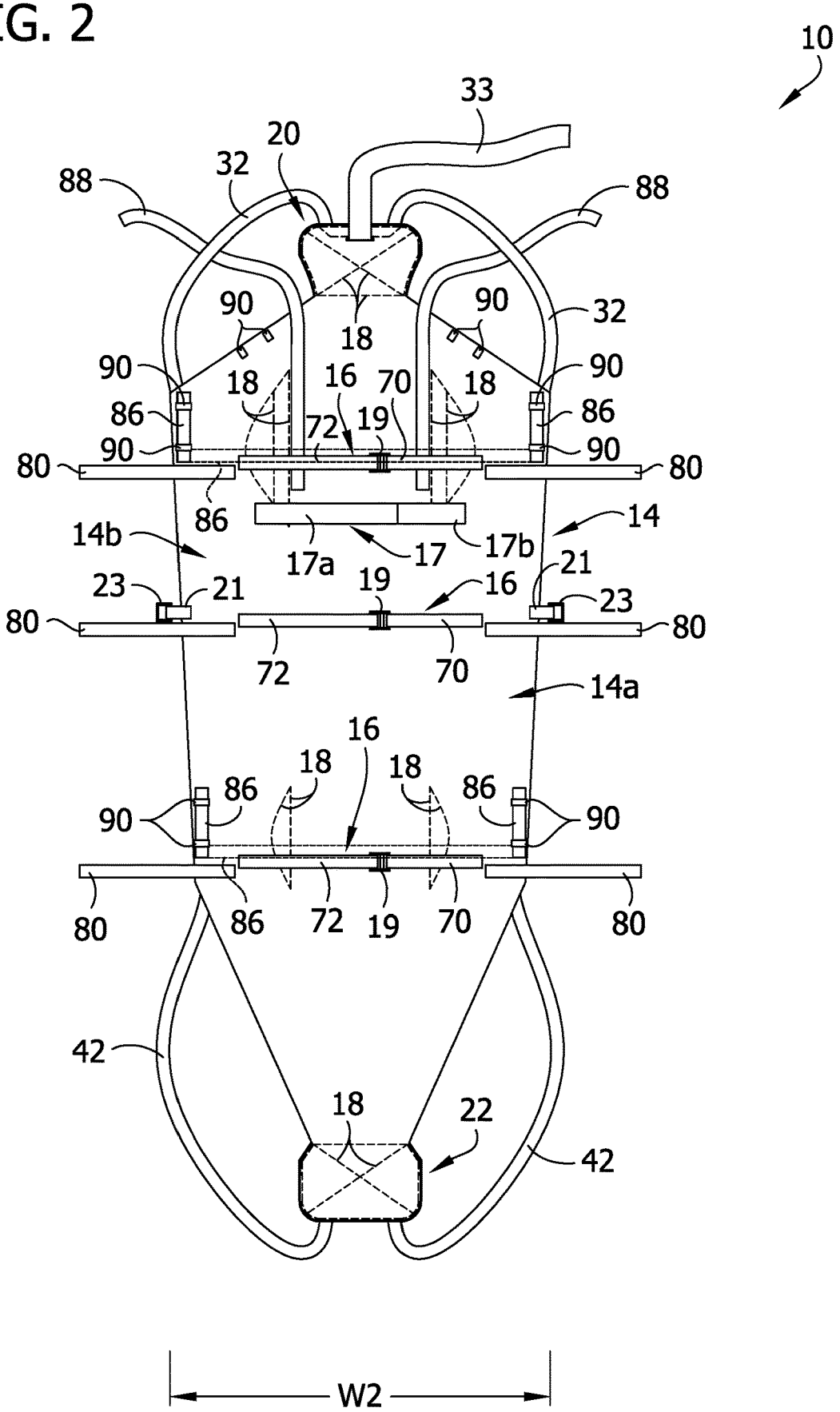
FIG. 2 is a top plan view of the sled in a laid flat configuration.
Figure 2A:
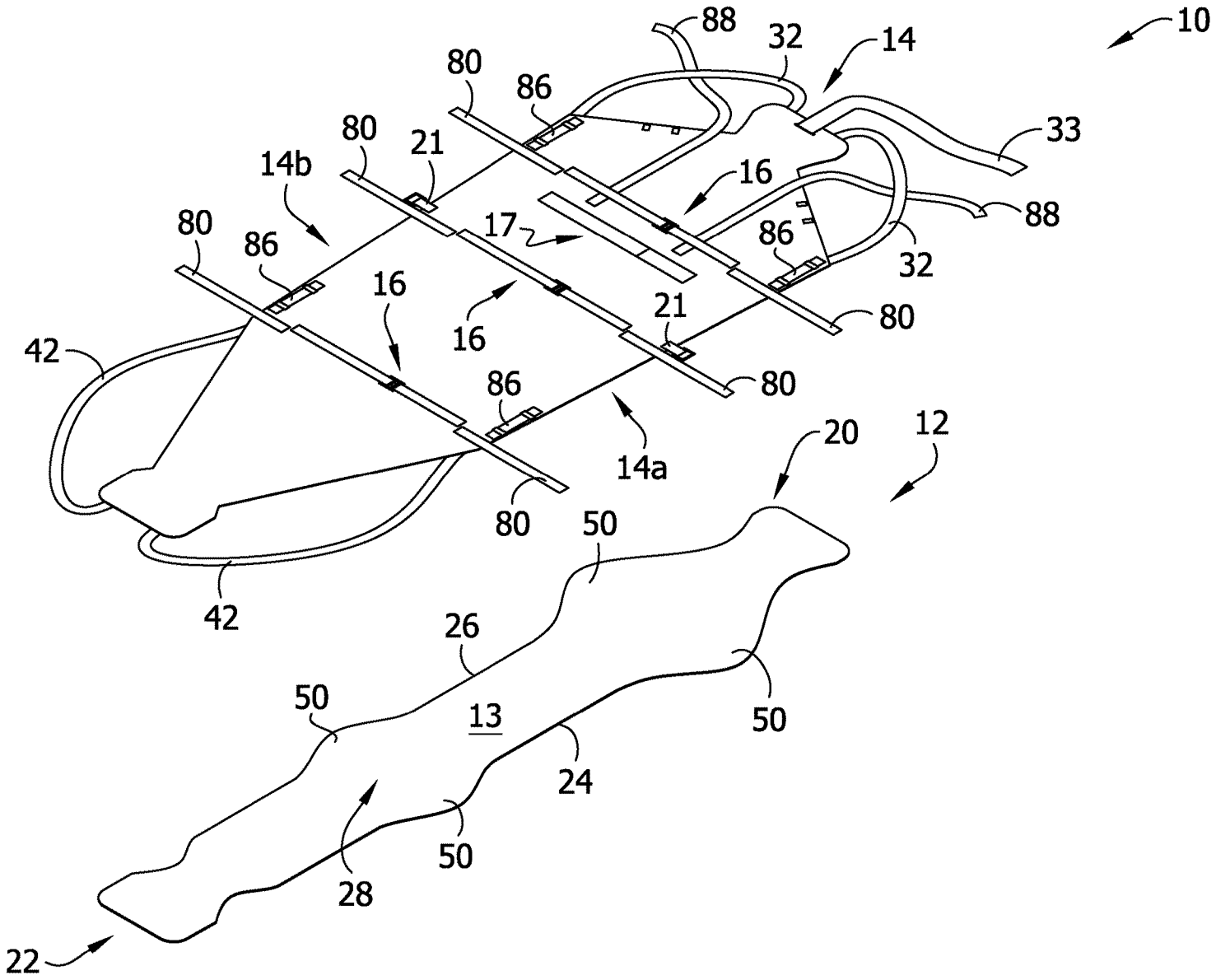
FIG. 2A is an exploded view thereof.
Figure 3:
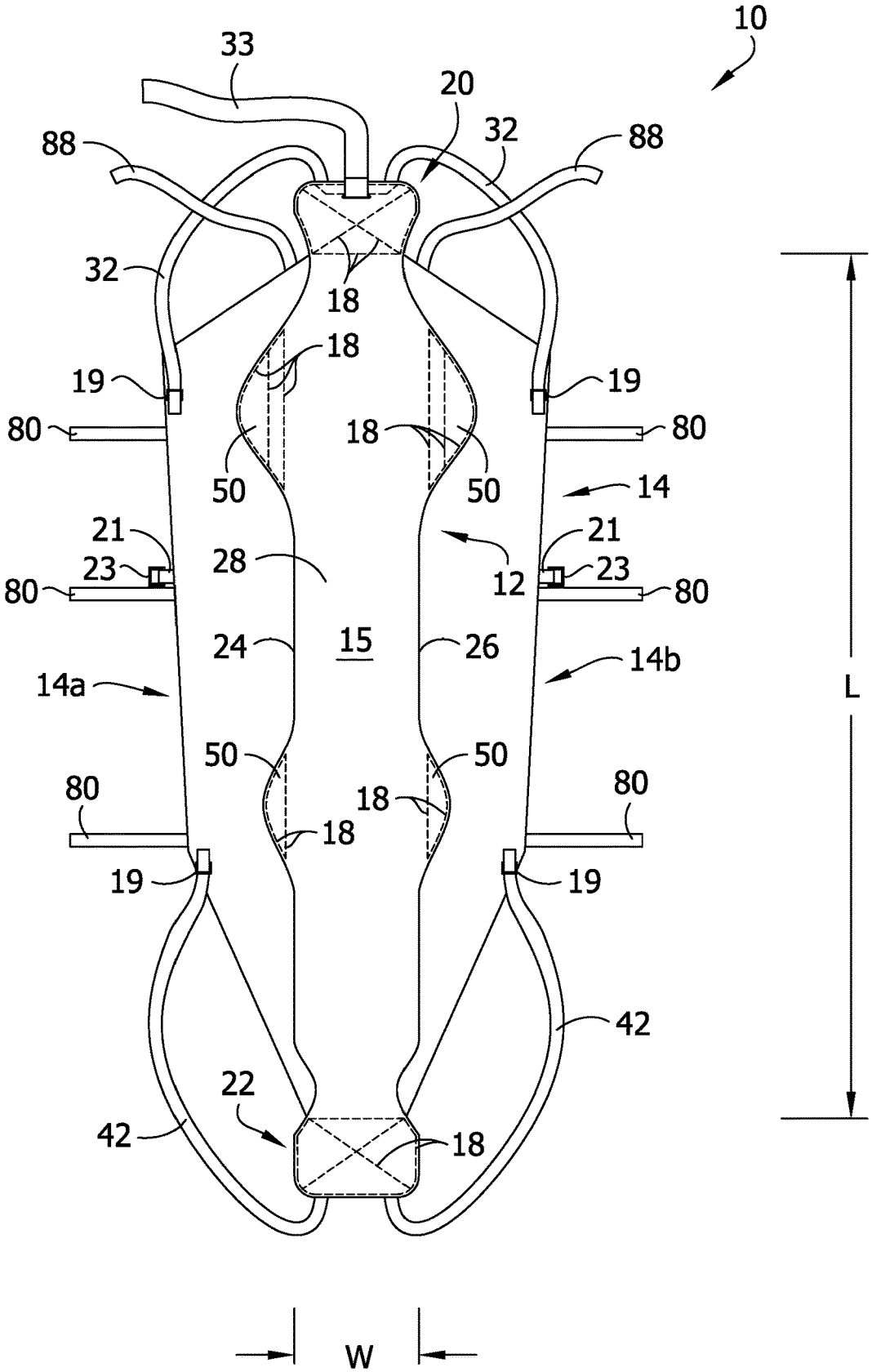
FIG. 3 is a bottom plan view of the sled of FIG. 2.

When the sled 10 is to be used, it is first is unrolled from a stowed position (FIG. 8) to a laid flat configuration such as is illustrated in FIGS. 2 and 3. The flexible panel 12 of the transport device 10 includes a head portion 20, a foot portion 22 opposite the head portion, and has first and second sides 24 and 26, respectively, extending between the head and foot portions (FIG. 3). The flexible panel 12 also includes a base portion or bed 28 extending between the head and foot portions 20, 22 and between the first and second sides 24, 26. The base portion 28 has a length L that extends between the head and foot portions 20, 22 of the flexible panel 12 (FIG. 3) and a width W that extends between the first and second sides 24, 26. In one embodiment, the length L of the base portion 28 is about 7 ft. (2.1 m) and the width W of the base portion is about 1 ft. (0.3 m). The base portion 28 is sized and shaped to underlie a human adult lying down (e.g., supine) position so that in use to drag the person in the sled 10, only the base portion contacts the ground. The flexible panel 12 has a peripheral edge margin, an upper surface 13 (FIG. 2A) and a lower surface 15. The flexible panel 12 has a thickness extending between the upper and lower surfaces.

In one embodiment, the flexible panel has a thickness of about 3/32 inches (2 mm). The sled 10 and various components thereof can have other dimensions than described without departing from the scope of the present disclosure. As discussed in more detail below, a lower surface 15 of the flexible panel 12, specifically, the portion of the lower surface defined by the base portion 28, may function as a slide surface to enable the transport device 10 to slide over the ground or floor for dragging (e.g. moving) a person lying within the transport device.

Referring to FIGS. 1-3, the head portion 20 extends from one end of the base portion 28 to a free end. As shown in FIG. 1, in use, the head portion 20 is resiliently bendable in an upward direction for extending along the head of person lying on the base portion 28. In the unbent position, the head portion 20 is generally flat and co-planar with the base portion 28. Two head straps 32 are connected on either side of the head portion 20 and are configured to bend (e.g., move) the head portion upward. When the head portion 20 is bent upward by head straps 32, the head portion has a generally arcuate shape that receives the head of the person being held by the sled 10. In the preferred embodiment, the two head straps 32 extend from the free end of the head portion 20 to the sheet 14 and are each connected to the sheet portion with a connector 19. As used herein, the term connector 19 includes, but is not limited to, a buckle, a releasable quick-connect fastener such as a snap buckle or seat belt type coupler, a hook and loop fastener (e.g., Velcro), or any other suitable device. In this case, the connectors 19 are each attached in a suitable manner to the underside of the sheet 14 near peripheral edges of the first and second sheet portions 14*a*, 14*b*. In the illustrated embodiment, this connector 19 is a buckle capable of changing the effective length of the strap 32. As generally known in the art, these connectors may vary the length of the strap or straps coupled to them. The two head straps 32 are adjustable in length. Reducing the length of the head straps 32 moves the head portion 20 into the arcuate shape and maintains the head portion in the arcuate shape. The adjustable length of each head strap 32 allows an operator (e.g., a rescuer) to adjust (e.g., vary) the arcuate shape of the head portion 20 to adjust the configuration of the sled 10 to fit the person lying therein. In one embodiment, a storage strap 33 is also connected to the head portion 20 and extends therefrom. The storage strap 33 is configured to extend around the sled 10 when the sled is in the stowed configuration to hold the sled in the stowed configuration (see, FIG. 8).

The foot portion 22 extends from an end of the base portion 28, opposite the head portion 20, to a free end. As shown in FIG. 1, in use, the foot portion 22 is resiliently bendable in an upward direction for extending along and/or surrounding the feet of a person lying on the base portion 28. In the unbent position, the foot portion 22 is generally flat and co-planar with the base portion 28. Two foot straps 42 are connected on either side of the foot portion 22 and are configured to bend (e.g., move) the foot portion upward. When the foot portion 22 is bent upward, the foot portion has a generally arcuate shape that can receive the feet of the person being held by the sled 10. In the preferred embodiment, the two foot straps 42 extend from the free end of the foot portion 22 to the sheet 14 and are each connected to the sheet portion with a connector 19. The two foot straps 42 are adjustable in length. Reducing the length of the foot straps 42 moves the foot portion 22 into the arcuate shape and maintains the foot portion in the arcuate shape. The adjustable length of each foot strap 42 allows the operator (e.g., a rescuer) to adjust (e.g., vary) the arcuate shape of the foot portion 22 to adjust the configuration of the sled 10 to fit the person lying therein.

Referring to FIG. 3, the flexible panel 12 may also include at least one wing 50 extending from either side 24, 26 of the flexible panel. For example, in the illustrated embodiment, the first and second sides 24, 26 of the flexible panel 12 each have two longitudinally spaced apart wings 50 extending therefrom. In this embodiment, the wings 50 closer to the head portion 20 than the foot portion 22 are disposed at a location on the base portion 28 that generally corresponds to the position of the upper arms or upper torso of the person lying down in the sled 10. The wings 50 closer to the foot portion 22 than the head portion 20 are disposed at a location on the base portion that generally corresponds to the position of the legs of the person. The wings 50 may be at other locations and may all have the same size and shape or different sizes and shapes. The location of the wings 50 generally corresponds to the location of the shoulders and mid-calves of the average sized person lying in the sled 10. In the illustrated embodiment, the wings 50 adjacent the foot portion 22 are smaller than the wings adjacent the head portion 20. Each wing 50 extends from the base portion 28 in a direction that is generally perpendicular to a longitudinal axis (extending between the head and foot portions 20, 22) of the sled 10. Each wing 50 has an outer edge margin (e.g., a portion of the peripheral edge margin of the flexible panel) that is generally convex in shape. In other embodiments, the wings 50 may have other shapes. As shown in FIG. 1, in use, each wing 50 is resiliently bendable in an upward direction for extending along a side of the person lying on the base portion 28. In one embodiment, a score line (not shown) extends along the lower surface 15 of the flexible panel 12 between the base portion 28 and each wing 50 to facilitate the bending of the wing in the upward direction. In use, the wings 50 may bend upward at generally any angle. For example, the wings may be disposed anywhere from about 0 degrees (e.g., generally horizontal) to about 90 degrees (e.g., generally vertical). Generally speaking, the wings 50 bend along a curve corresponding to the shape of the part of the person's body lying in the sled. As explained in more detail below, the wings 50 are used to connect the flexible sheet 14 to the flexible panel 12 and are configured to prevent this connection from engaging the ground or floor when the sled 10 is dragged. Moreover, the wings 50 provide stability while allowing the flexible panel 12 to be narrow in width overall. The wings 50 help to form the flexible panel 12 into a curved shape that rigidifies the flexible panel in use to prevent bending of the flexible panel under the weight of the patient in the sled 10.

The flexible panel 12 is preferably formed from a flexible, yet rigid and durable material. Such a material can include, but is not limited to, High Density Polyethylene ("HDPE") plastic, or any other suitable material.

Still referring to FIGS. 1-3, the sheet 14 is connected to the flexible panel 12 and extends laterally outward from each side 24, 26 of the flexible panel. The sheet 14 extends along the side 24, 26 generally from the head portion 20 to the foot portion 22. Thus, the sheet 14 has a length generally equal to the length L of the base portion 28. A first sheet portion 14*a* of the sheet 14 is connected to the first side 24 of the flexible panel and extends in a direction that is generally away from the second side 26 (e.g., outward) to a free, peripheral edge margin. The first sheet portion 14*a* extends past the wings 50 extending outward from the first side 24 of the flexible panel 12 (e.g., the peripheral edge margin of the first sheet portion is disposed outward from the peripheral edge margin of the flexible panel). Similarly, a second sheet portion 14*b* of the sheet 14 is connected to the second side 26 of the flexible panel and extends in a direction that is generally way from the second side 26 (e.g., outward) to a free, peripheral edge margin. The second sheet portion 14*b* extends past the wings 50 extending outward from the second side 26 of the flexible panel 12 (e.g., the peripheral edge margin of the second sheet portion is disposed outward from the peripheral edge margin of the flexible panel). As shown in FIG. 2, the free, peripheral edge margin of each sheet portion 14*a*, 14*b* has a first, angled section extending generally outward from adjacent the head portion 20 of the flexible panel 12, a second section extending generally parallel to the longitudinal axis of the sled 10 from the end of the first section and a third, angled section extending inward to adjacent the foot portion 22 from the end of the second section. The first and second sheet portions 14*a*, 14*b* are generally mirror images of each other. The first sheet portion 14*a* overlies the wings 50 extending from the first side 24 of the flexible panel 12 and the second sheet portion 14*b* overlies the wings extending from the second side 26 of the flexible panel. In the illustrated embodiment, the first and second sheet portions 14*a*, 14*b* are part of the single, unitary sheet 14. However, the first and second sheet portions 14*a*, 14*b* may be separate from each other within the scope of the present invention. Still further, the sheet 14 may be made up of any number of distinct portions (not shown) that are connected to each other or connected separately to the flexible panel 12.

As shown in FIG. 2, in the flat configuration, the sled 10 has an overall width W2 extending between the peripheral edge margins of the sheet 14 that is greater than the width W of the base portion 28. Each of the first and second sheet portions 14*a*, 14*b* is configured to extend in an upward direction, along the side of the person lying on the base portion 28. In one embodiment, sections of the first and second sheet portions 14*a*, 14*b* are folded back on themselves and secured in place, such as by stitching, to form the peripheral edge.

A plurality of connections 18 connects the sheet 14 to the flexible panel 12. In one embodiment, the connections 18 comprise stitching passing through the flexible panel 12 and sheet 14 to connect the two components together. The stitching can be made with a polymeric thread or any other suitable material. In one embodiment, the connections 18 comprise an adhesive disposed between the sheet 14 and the flexible panel to bond the sheet portions to the upper surface 13 of the flexible panel. The adhesive is preferably of a type that forms a strong bond and can bond to both plastic and fabric materials. Other ways of connecting the sheet 14 to the flexible panel 12 may be used. In the preferred embodiment, the connections 18 between the sheet 14 and the flexible panel 12 are disposed adjacent the peripheral edge of the flexible panel. However, it is understood the connections 18 can be disposed at generally any location on the flexible panel 12. For reasons that will become apparent, in the preferred embodiment, any the connections 18 that comprise stitching are only disposed on the head portion 20, foot portion 22 and wings 50 of the flexible panel 12. The connections 18 comprising stitching occur only at these positions to prevent the stitching from being worn and damaged when the sled 10 is dragged across the ground. In the illustrated embodiment, the sled 10 includes connections 18 composed of stitching connecting the first sheet portion 14*a* to the wings 50 extending from the first side 24 of the flexible panel 12 and connecting the second sheet portion 14*b* to the wings extending from the second side 26 of the flexible panel. The stitching of these connections 18 extends adjacent to and along the peripheral edge of the wings 50 as well as across the wings. As shown a line of stitching 18 extends around the wing 50 in a closed configuration corresponding generally to the shape of the wing. An additional line of stitching extends across the closed shape. Additional lines of stitching may be added.

As shown in the illustrated embodiment, the sheet 14 overlies the base section 28 of the flexible panel 12. In one embodiment (not shown), connections 18 comprising adhesive connect the sheet 14 to the base section 28 of the flexible panel 12. For example, two connections 18 of adhesive may extend longitudinally along the base section 28 adjacent each side 24, 26 of the flexible panel 12. In the illustrated embodiment, the sheet 14 also overlies the head portion 20 and/or foot portion 22, closely conforming to the shape of the respective heat portion or foot portion. In this embodiment, connections 18 comprising stitching and/or adhesive can be used to connect the sheet 14 to the head and foot portions 20, 22. For example, connections 18 of stitching extend adjacent to and along the peripheral edge of the head and foot portions 20, 22, at the juncture between the head and foot portions with the base portion 28 as well as across the head and foot portions, such as in an X-configuration. Moreover, connections 18 of adhesive may also be used in conjunction with the stitching to secure the sheet 14 to the head and foot portions 20, 22 (not shown).

The sheet 14 is preferably made from a limp and flexible material that is strong enough to support the weight of the person contained in the sled 10. Preferably, the material the sheet 14 is made from is lighter than the material the flexible panel 12 is made from to reduce the weight of the sled 10. Such material can include, but is not limited to, fabric woven from Ultra-High Molecular Weight Polyethylene, or fabric made from other similar flexible high strength materials. Generally, the sheet 14 is a high-strength flexible fabric whereas the flexible panel 12 is a flexible, yet relatively harder panel. Accordingly, it is understood the flexible panel has a greater resistance to wear and tear, such as from dragging the sled across the ground, than the sheet 14. Preferably, the weight of the entire sled 10 is less than or equal to 15 pounds, more preferably less than 10 pounds and most preferably five pounds or less.

Figure 7:
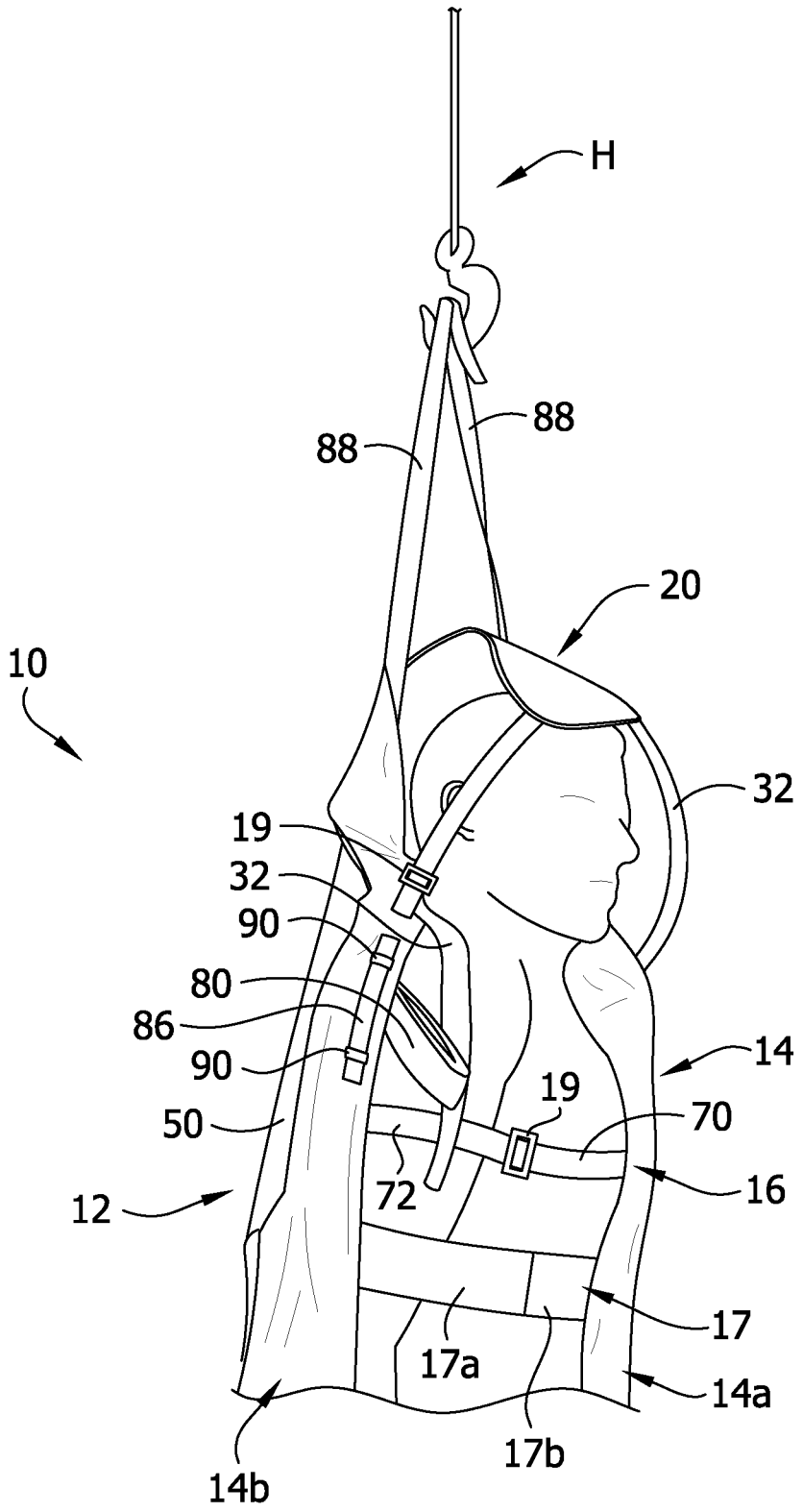
FIG. 7 is a perspective of the sled being vertically lifted by a hoist.

Referring to FIGS. 1-3, the sled 10 includes straps and strap assemblies (e.g., strapping) for use in securing the patient in the sled and for lifting and transporting the sled. As mentioned above, the sled 10 includes head and foot straps 32, 42 configured to bend the head and foot portions 20, 22 upward. The sled 10 also includes a patient control belt 17 and three harness strap assemblies 16 configured to secure the person in the sled. The patient control belt 17 includes two belt members 17*a*, 17*b* connected to opposite ones of the first and second sheet portions 14*a*, 14*b*. The two belt members 17*a*, 17*b* can be releasably connected, such as by hook and loop fastener elements to extend across the patient's arms and torso to keep the arms within the sled 10. This is best seen in FIG. 7 of the drawings. Each harness strap assembly 16 includes first and second straps 70 and 72, respectively, connectable by a connector 19. The first strap 70 is connected to the first sheet portion 14*a* and the second strap 72 is connected to the second sheet portion 14*b*. In the preferred embodiment, the first and second straps 70, 72 are connected to the sheet 14 outward of the sides 24, 26 of the flexible panel 12 but inward of the peripheral edge of the sheet portions. For example, in one embodiment, the first and second straps 70, 72 are each connected to and extend from a respective one of the first and second sheet portions

14*a*, 14*b* at a position that is approximately halfway between the peripheral edge of the sheet portion and the side 24, 26 of the flexible panel 12. In other embodiments, the first and second straps 70, 72 may be connected to the sheet panels 14 at other positions, such as the peripheral edge. When connected together by the connector 19, the first and second straps 70, 72 extend across the base section 28 of the flexible panel 12. In the illustrated embodiment, the harness strap assemblies 16 longitudinally spaced apart along the length L of the base section 28. Two of these harness strap assemblies 16 are configured to extend across the arms and torso of the person lying in the sled 10, one harness strap assembly is configured to extend across the hips of the person, and another harness strap assembly is configured to extend across the legs of the person. As explained in more detail below, the harness strap assemblies 16 are configured to pull (e.g., bend) the sheet portions 14*a*, 14*b* and wings 50 around the person lying in the sled 10. The number and arrangement of the patient control belt 17 and harness strap assemblies 16 can be other than described herein within the scope of the present invention.

The sled 10 includes four long horizontal lifting straps 86 and two short horizontal lifting straps 21 configured to be connected to a lift or hoist H to raise (e.g., lift) the sled 10 in a generally horizontal position. Each of the long horizontal lifting straps 86 is connected to and extends from a first location on the peripheral edge of the sheet 14. Each long horizontal lifting strap 86 includes a connector 19. Two of the long horizontal lifting straps 86 are connected to the first and second sheet portions 14*a*, 14*b*, respectively, generally opposite each other toward the head portion 20 of the sled 10. Two of the long horizontal lifting straps are connected to the first and second sheet portions, respectively, generally opposite each other toward the foot portion 22. In the preferred embodiment, the opposing horizontal lifting straps 86 on either side of the sled extend toward each other along the sheet 14 and the base section 28 of the flexible panel 12 and are connected together. As shown, the opposite horizontal lifting straps 86 are each sections of a continuous, one piece strap that extends across the sheet 14 and over the upper surface 13 of the flexible panel 12. The extension of the one piece horizontal lifting straps 86 across the sled 10 is shown by hidden lines in FIG. 2. Moreover, in the preferred embodiment, the horizontal lifting straps 86 are connected to the sheet 14 at the same location as the first and second straps 70, 72 of the harness strap assemblies so that these different straps can be connected together. Each short horizontal lifting strap 21 is attached to the sheet 14 between locations where the long horizontal lifting straps 86 are connected, and has a connector 23. In the illustrated embodiment, each of the two short straps 21 is attached near the longitudinal middle of the sled, adjacent the middle harness strap assembly 16. As described more fully below, the long horizontal lifting straps 86 near the head portion 20 of the sled 10 can be connected to each other to form one loop. The long horizontal lifting straps 86 nearer to the foot portion 22 of the sled can each be connected to a corresponding one of the short straps 21 to form two additional loops. The three loops can be received on a hook of a hoist H (FIG. 6) to raise a patient in the sled in a horizontal orientation. The sled 10 can be connected to a hoist H by other methods. It is to be understood that while the harness strap assemblies 16 and the horizontal lifting straps 86 may extend from the sheet 14 at different locations, sections of each strap will extend over the sheet portion to connect each respective strap to the sheet portion, and it is these sections of the straps that are preferably connected together. For example, the strap section connecting the first or second straps 70, 72 of the harness strap assemblies 16 to the sheet 14 may overlie the strap section connecting the horizontal lifting strap 86 to the sheet portion. It will be understood that either the four long horizontal lifting straps 86 or two short horizontal lifting straps 21 may also be used for vertical lifting. Moreover, through adjustments using the connectors 19 and/or 23, the sled 10 may be angled anywhere between horizontal and vertical. This permits greater flexibility in orienting the patient in the sled 10 in ways that are beneficial to the patient, but also to adjust for easier reception onto the particular platform (e.g., helicopter, ravine edge, etc.) to which the patient is being lifted.

The sled 10 may also include at least one vertical lifting strap 88 configured to be connected to a lift or hoist H to raise (e.g., lift) the sled 10 in a generally vertical position. In the illustrated embodiment, the sled 10 includes two vertical lifting straps 88 positioned on either side of the head portion 20. Each vertical lifting strap 88 is connected to a respective one of the first and second sheet portions 14*a*, 14*b* adjacent the peripheral edge of the flexible panel 12 and extends therefrom. In one embodiment, the vertical lifting straps 88 extend along the first and second sheet portions 14*a*, 14*b* so that they overlap and are connected to at least one of the harness strap assemblies 16 and/or at least one of the horizontal lifting straps 86 that extend across the sheet portions. The overlap of the vertical lifting straps 88 with the horizontal lifting straps 86 may be seen in FIG. 2. For example, in the illustrated embodiment, the vertical lifting straps 88 overlie and are connected to the horizontal lifting straps 86 near the head portion 20. Each vertical lifting strap 88 can include a connector 19 (not shown). In one embodiment, the connector 19 is a buckle that forms a loop at the free end of the lifting strap that can be hooked onto a hook of the hoist.

Figure 4:
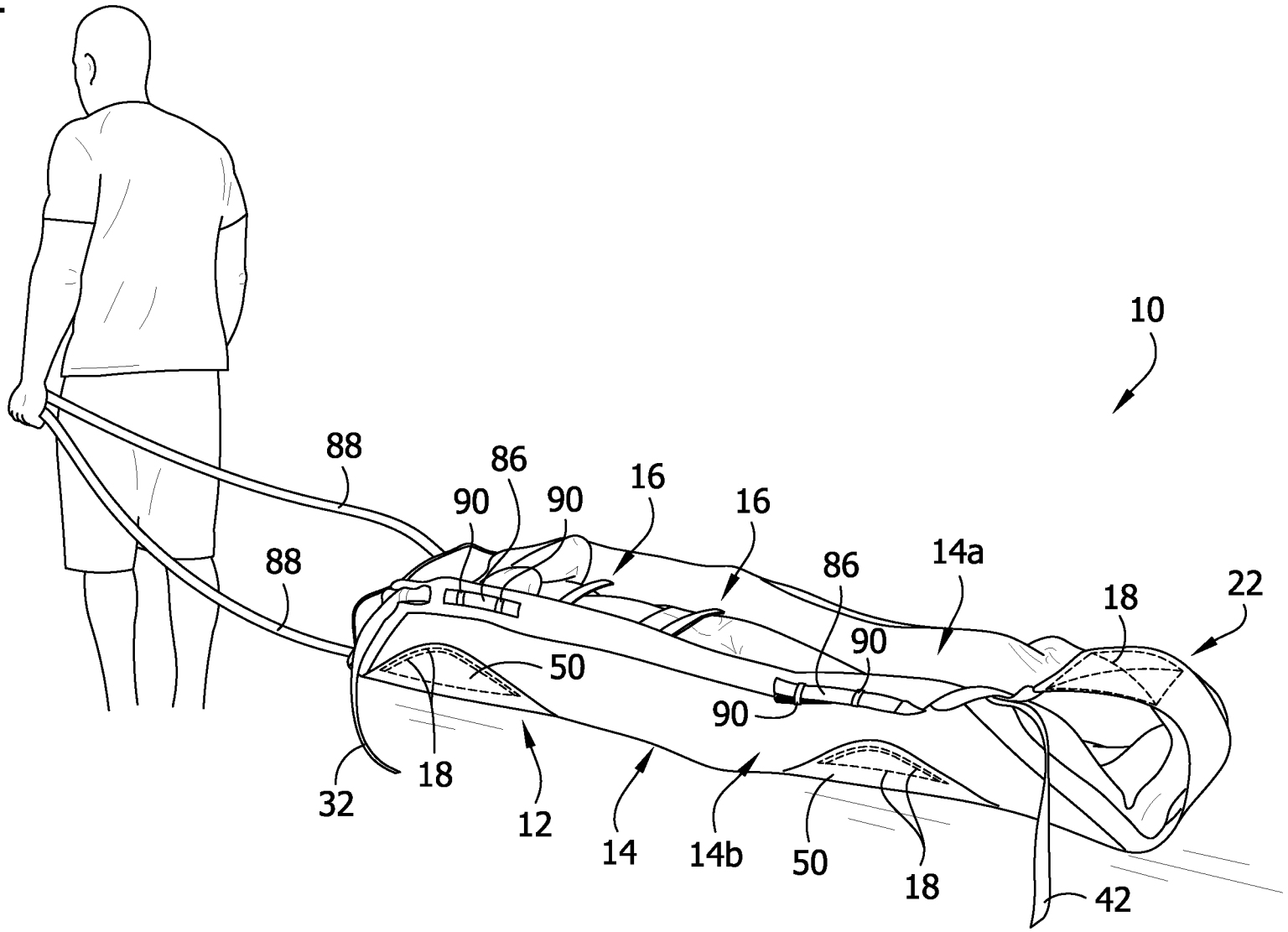
FIG. 4 is a perspective of the sled carrying an evacuee and being dragged across the ground.

In the illustrated embodiment, strapping of the sled 10 may also include storing retainers 90 adjacent to each horizontal and vertical lifting strap 86, 88. The storing retainers 90 are connected to the peripheral edge of the sheet 14 and are configured to hold their corresponding horizontal or vertical lifting strap 86, 88 in a stored configuration. In the stored configuration, sections of the horizontal and vertical lifting straps 86, 88 are folded back on each other and then held in this folded state by the storing retainers 90. FIGS. 1, 2, 4, and 5 show the horizontal lifting straps 86 in the stored configuration. FIG. 1 shows the vertical lifting straps 88 in the stored configuration. FIGS. 4, 6, and 7 show either the horizontal or vertical lifting straps 86, 88 in their deployed (e.g., not stowed) configuration. In the illustrated embodiment, there are two storing retainers 90 adjacent each horizontal or vertical lifting strap 86, 88 that surround and hold the lifting strap in a folded (e.g., stored) configuration. Each storing retainer 90 includes two sections that are connected together with a connector 19, such as hook and loop fasteners (e.g., Velcro), to surround the horizontal or vertical lifting strap 86, 88.

Referring to FIGS. 1-3, the sled 10 may also include a plurality of handles 80 at or adjacent to the peripheral edge margin of the sheet 14. In the illustrated embodiment, three handles 80 are longitudinally spaced apart along the peripheral edge margin respective ones of the first and second sheet portions 14*a*, 14*b*. In the illustrated embodiment, each handle 80 is connected as by stitching to the sheet portion 14*a* or 14*b* adjacent one of the harness strap assemblies 16. The handles 80 include a closed loop that is configured to receive a pole 84 therein (FIG. 5), as described in more detail below. However, the sled 10 can be picked up by directly grasping the handles 80. In the preferred embodiment, each handle 80 is a piece of strapping folded back on itself to form a closed loop.

The various straps described herein may be connected to the sheet 14 and/or flexible panel 12 by any suitable method, such as by stitching, as described above. In one embodiment, some of the connections 18 of stitching connecting the sheet 14 to the flexible panel 12 may also extend through and connect straps to the sheet portions and flexible panel. For reasons that will become apparent, any stitching connecting the strapping to the flexible panel 12 will, preferably, only occur on the head portion 20, foot portion 22 and/or wings 50. Any stitching connecting the strapping to the sheet 14 can occur anywhere thereon. The straps (e.g., strapping) described herein can be made from any suitable material, such as but not limited to Kevlar or nylon. In one embodiment, the straps are made from the same material as the sheet 14.

Referring to FIGS. 4-7, various ways of using the sled 10 will now be described. In one embodiment of securing a person to the sled 10, the sled is unrolled from the stowed configuration and laid flat on the ground. A person is moved (e.g., slid or rolled) onto the sheet 14 to a position in the center of the sheet overlying the upper surface 13 of the flexible panel 12 (specifically, the base section 28) such that the head of the person is positioned adjacent the head portion 20 and the feet of the person are positioned adjacent the foot portion 22. The straps 70, 72 of the harness strap assemblies 16 are connected together over the person. As the harness strap assemblies 16 are tightened, the first and second sheet portions 14*a*, 14*b* and wings 50 are bent upward and extend along the side of the person (e.g., the strap assemblies pull the sheet portions in an inward direction toward one another). Bending the wings 50 upward also stiffens the flexible panel 12 into a more rigid support on which the person can be carried. In the illustrated embodiment, the first and second sheet portions 14*a*, 14*b* extend generally vertically along the side of the person. The head straps 32 are shortened to bend the head portion 20 upward toward the head of the person. Similarly, the foot straps are shortened to bend the foot portion 22 upward toward the feet of the person. Moving the head and foot portions 20, 22 into their respective arcuate shapes by shortening the head and foot straps 32, 42 conforms the sled to the particular height of the person lying therein. Accordingly, in some embodiments where the person secured in the sled 10 is short, it is understood that the bending of the foot portion 22 may also bend a portion of the base section 28 upward (and possibly back over itself) when the foot portion is bent over the feet of the shorter person. When the first and second sheet portions 14*a*, 14*b*, head portion 20 and foot portion 20 are bent upward, the sled 10 generally cocoons the person therein and keeps the person on the base section 28 of the flexible panel 12.

Once the person is secured in the sled 10, the sled can be used to transport (e.g., move) the person in a variety of ways from an emergency situation. In one embodiment, one or more operators (e.g., rescuers) drag the sled 10 over the ground by grabbing and pulling the handles 80 and/or the vertical lifting straps 88. When the sled 10 is dragged across the ground, the lower surface 15 of the flexible panel (specifically, the portion of the lower surface defined by the base section 28) contacts and slides over the ground. As explained above, the flexible panel 12 is made of a durable material that is capable of sliding over the ground while experience little to no damage, even over rough terrain. The material of the flexible panel 12 is also smooth so as to provide minimal resistance to sliding. In contrast, the sheet 14 may not be made of a material that is capable of sliding over terrain without experiencing damage, such as tearing or ripping. Moreover, when the sled 10 is dragged across the ground, the stitching 18 that connect the sheet 14 to the flexible panel 12 does not contact or engage the ground. It is understood that the stitching 18 extends through the flexible panel 12 and if the stitching were to contact the terrain the sled 10 is pulled over, the stitching may rip or tear—thereby allowing the flexible panel and sheet 14 to become disconnected. The stitching 18 does not contact the ground because it is, preferably, only located the head portion 20, foot portion 22 and wings 50 of the flexible panel 12, which are bent upward, away from the ground, when the person is secured in the sled, as described above. Accordingly, the only portion of the flexible panel 12 that contacts the ground is the base section 28 which, preferably, does not include any stitching 18.

Figure 5:
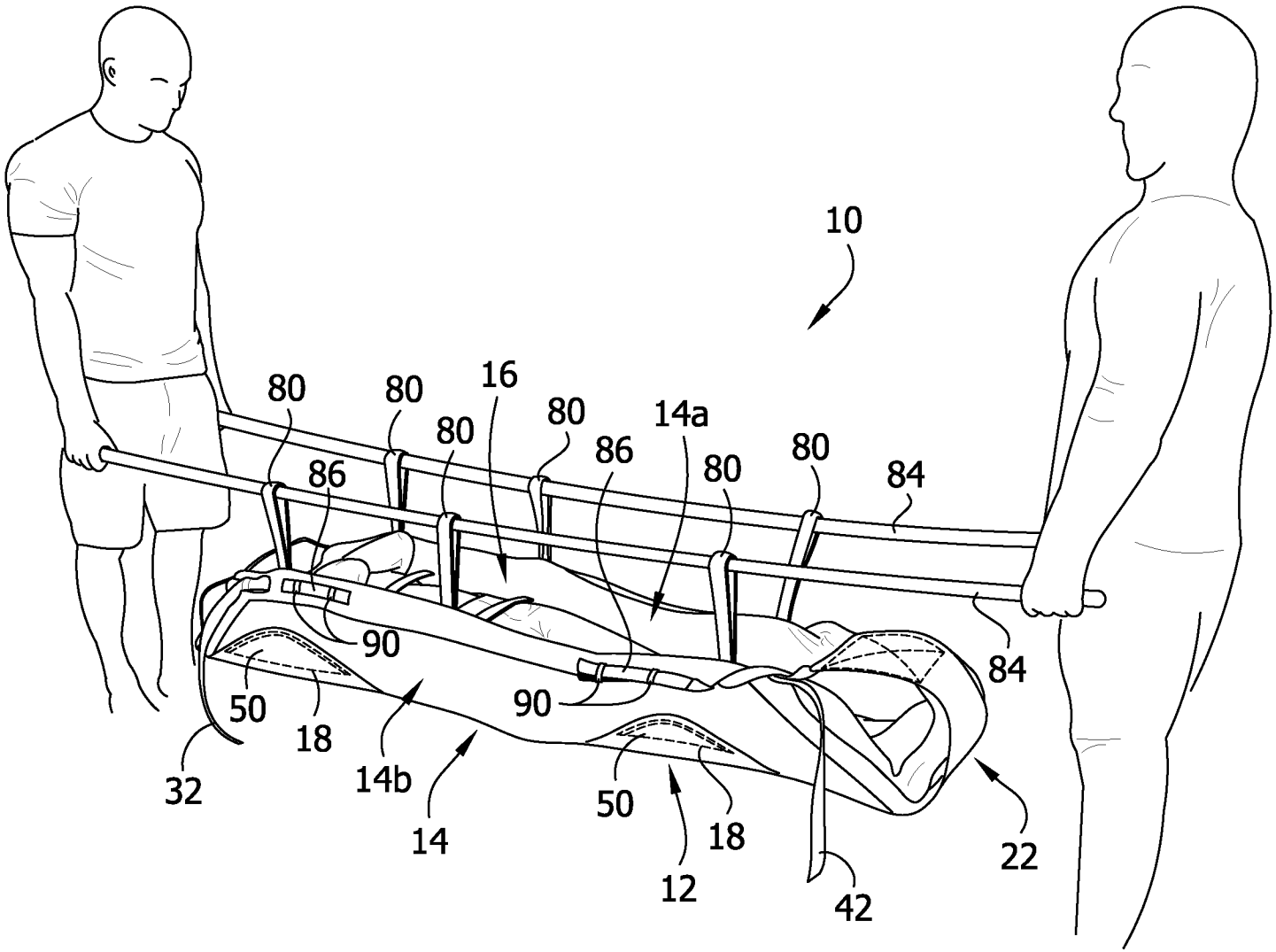
FIG. 5 is a perspective of the sled being carried by two people with a pair of poles.
Figure 6:
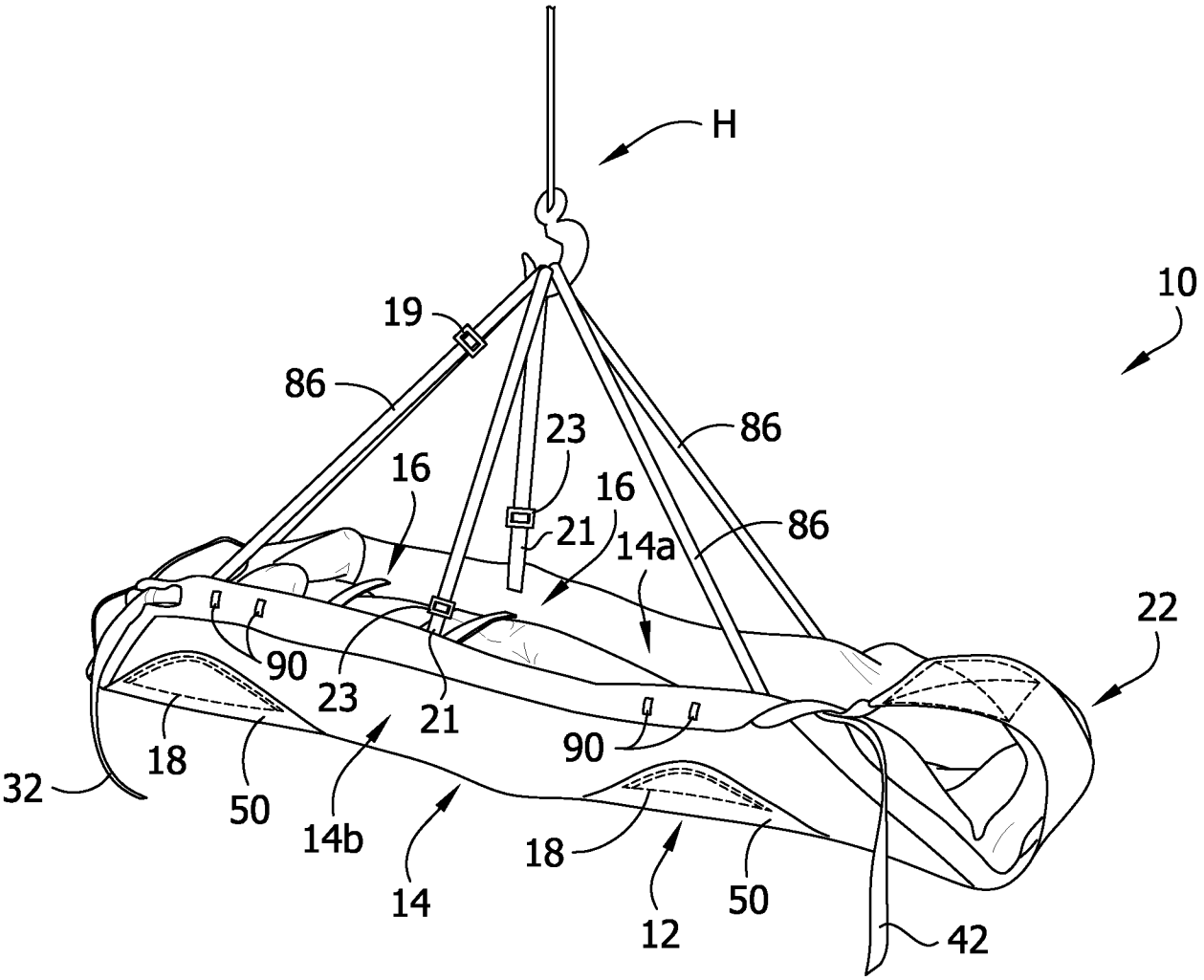
FIG. 6 is a perspective of the sled being horizontally lifted by a hoist.

Referring to FIG. 5, in another manner of moving a person with the sled 10, the sled 10 can be lifted by two or more operators (e.g., rescuers) using a pair of poles 84 coupled to the sled 10. In this embodiment, one pole 84 is inserted through the closed looped handles 80 connected to the first sheet portion 14*a* and the second pole is inserted through the closed looped handles connected to the second sheet portion 14*b*. Two operators, standing at each end of the sled 10, grab an end of each pole 84 to lift and move the sled. In one embodiment, the poles 84 may be telescoping (e.g., collapsible) to be easily stored. Alternatively, the two or more operators can grab the handles 80 directly to lift and move the sled 10.

In another manner of moving a person with the sled 10, the horizontal and/or vertical lifting straps 86, 88 are coupled to a hoist H (or any other lifting device) and the sled is lifted from an emergency situation. For example, the sled 10 can be coupled to a hoist H of a helicopter to vertically evacuate the sled from the emergency situation. In one embodiment, the horizontal lifting straps 86 are coupled to the hoist to lift the sled 10 in a generally horizontal orientation (FIG. 6). In that case, the opposite, long horizontal lifting straps 86 are removed from the retainers 90 and their connectors 19 are attached to form a first support loop. The two opposite, long horizontal lifting straps 86 near the foot portion 22 are removed from their retainers. One of the long horizontal lifting straps 86 is connected to the short horizontal lifting strap 21 by way of the connector 23, and the other of the long horizontal lifting straps is connected to the other short horizontal lifting strap to form second and third loops. Once both ends of the horizontal lifting straps 86 near the foot portion 22 are connected to the sheet 14 via the short horizontal lifting straps 21 and connectors 23, an intermediate section of each of the three loops can be positioned over a hook (or other similar device) of the hoist H. The lengths of the various horizontal lifting straps 86 may also be adjusted such that the sled 10 is suitably adjusted, such as to be tilted at slight angle relative to the horizontal so that the head of the patient is slightly higher than his feet. In one embodiment, the vertical lifting straps 88 are coupled to the hoist to lift the sled 10 in a generally vertical position (FIG. 7). For example, in the illustrated embodiment, the two vertical lifting straps 88 have a looped free end that is connected to a hook (or other similar device) of the hoist. The horizontal and vertical lifting straps 86, 88 may be used in other manners than described herein.

Referring to FIG. 8, the sled 10 is capable of being rolled into a compact form (e.g., stowed configuration) for easy transport and storage. In this stowed configuration, the sled 10 is rolled into a cylinder having a height less than 16 inches and a diameter less than 6 inches. To place the sled 10 in the stowed configuration, the sled is laid flat, as shown in FIG. 2, and then any the horizontal and vertical lifting straps 86, 88 are secured in their stored configuration with storing retainers 90. Next, the wings 50 and side portions 14 are folded over onto the base section 28 and then the sled 10 is rolled up from the foot portion 22 to the head portion 20. Once rolled up, the storage strap 33 extends around and holds the sled 10 in the stowed configuration. The sled 10 can then be placed in a storage bag such as a backpack.

Having described the invention in detail, it will be apparent that modifications and variations are possible without departing from the scope of the invention defined in the appended claims. For example, where specific dimensions are given, it will be understood that they are exemplary only and other dimensions are possible.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A compact, portable sled for transporting a person, the sled comprising:

a flexible panel comprising a head portion, a foot portion, a first side and a second side, a sled length extending from the head portion to the foot portion, a sled width extending from the first side to the second side, each of the first and second sides extending from the head portion toward the foot portion, the flexible panel being constructed of a wear resistant material for dragging over rough terrain;

sheet portions made of limp material that is less resistant to wear than the material of the flexible panel, the sheet portions being attached to the flexible panel, one of the sheet portions extending laterally outwardly from the first side of the flexible panel and another of the sheet portions extending laterally outwardly from the second side of the flexible panel;

the flexible panel and sheet portions being collapsible to a compact configuration and expandable from the compact configuration to a use configuration in which the person may be received on the sled for transporting; and strapping comprising a horizontal lifting strap having a transverse portion extending from the sheet portion on the first side of the flexible panel to the sheet portion on the second side of the flexible panel, and a vertical lifting strap extending along the sled length transverse to the lengthwise extent of the transverse portion of the horizontal lifting strap from a position crossing over the transverse portion of the horizontal lifting strap to a position outward of the head portion of the flexible panel whereby the vertical lifting strap is configured for use in dragging the sled over the terrain and for using in lifting the sled in a vertical orientation, the vertical lifting strap being secured to the transverse portion of the horizontal lifting strap.

2. The sled as set forth in claim 1 further comprising connections between the sheet portions and the flexible panel, the connections being located at a peripheral edge margin of the flexible panel.

3. The sled as set forth in claim 2 wherein the connections comprise stitching.

4. The sled as set forth in claim 3 wherein the stitching comprises a polymeric thread passing through the flexible panel and the sheet portions.

5. The sled as set forth in claim 2 wherein the flexible panel comprises a base section and wings jutting outwardly from surrounding portions of the base section, at least some of the connections between the sheet portions and the flexible panel being located on the wings.

6. The sled as set forth in claim 5 wherein some of the connections are located on the head portion and the foot portion of the flexible panel.

7. The sled as set forth in claim 5 wherein the base section is located between the head portion and the foot portion and is free of connections between the flexible panel and the sheet portions.

8. The sled as set forth in claim 1 wherein the sheet portions are part of a unitary sheet overlying the flexible panel.

9. The sled as set forth in claim 8 further comprising handles connected to the unitary sheet at spaced apart locations for lifting the sled and the person when in the sled.

10. The sled as set forth in claim 9 further comprising collapsible poles sized and shaped for reception through the handles for carrying the person when in the sled.

11. The sled as set forth in claim 8 wherein the strapping comprises harness strap assemblies attached to the unitary sheet at spaced apart locations and extending widthwise of the flexible panel.

12. The sled as set forth in claim 11 wherein the harness strap assemblies comprise two straps and a connector releasably connecting ends of the two straps together, wherein the harness strap assemblies are configured to secure the person in the sled and pull the sheet portions toward each other when the connector connects the ends of the two straps together.

13. The sled as set forth in claim 11 wherein the horizontal lifting straps are connected to the unitary sheet and arranged for lifting the sled so that the flexible panel is generally horizontal.

14. The sled as set forth in claim 13 further comprising storing retainers that secure the horizontal lifting straps in a stored configuration when the horizontal lifting straps are not in use.

15. The sled as set forth in claim 13 wherein each horizontal lifting strap is connected to one of the harness strap assemblies.

16. The sled as set forth in claim 13 wherein the strapping further comprises plural vertical lifting straps, the vertical lifting straps being connected to the unitary sheet and arranged for lifting the sled so that the flexible panel is generally vertical.

17. The sled as set forth in claim 16 wherein each vertical lifting strap is connected to one of the harness strap assemblies.

18. The sled as set forth in claim 16 further comprising storing retainers that secure the vertical lifting straps in a stored configuration when the vertical lifting straps are not in use.

19. The sled as set forth in claim 1 wherein the sheet portions are foldable over onto the flexible panel and the flexible panel and sheet portions can be rolled into a cylinder having a height less than 16 inches and a diameter less than 6 inches.

20. The sled as set forth in claim 1 wherein the weight of the sled is less than or equal to 5 pounds.

21. The sled as set forth in claim 1 wherein the flexible panel comprises a base section and wings projecting laterally outward from the base section, the wings being shaped and arranged for forming the flexible panel into a channel configuration when the sled is lifted to rigidify the flexible panel and the sled.

22. A compact, portable sled for transporting a person, the sled comprising:

a flexible panel comprising a head portion, a foot portion, a first side and a second side, a sled length extending from the head portion to the foot portion, a sled width extending from the first side to the second side, each of the first and second sides extending from the head portion toward the foot portion, the flexible panel being constructed of a wear resistant material for dragging over rough terrain;

sheet portions made of limp material that is less resistant to wear than the material of the flexible panel, the sheet portions being attached to the flexible panel, one of the sheet portions extending laterally outwardly from the first side of the flexible panel and another of the sheet portions extending laterally outwardly from the second side of the flexible panel;

the flexible panel and sheet portions being collapsible to a compact configuration and expandable from the compact configuration to a use configuration in which the person may be received on the sled for transporting, the flexible panel comprises a base section having a perimeter including opposite longitudinal portions, each having a length from the head portion to the foot portion of the flexible panel, and wings jutting outward from surrounding portions of the longitudinal portions of the base section perimeter, each wing having a length that is less than a length of the base section perimeter longitudinal portion;

connections between the sheet portions and the flexible panel located on the wings.

23. The sled as set forth in claim 22 wherein the wings include a first wing and a second wing spaced apart from the first wing along one of the opposite longitudinal portions of the base section perimeter, and a third wing and a fourth wing spaced apart from the third wing along the other of the opposite longitudinal portions of the base section perimeter.

24. A compact, portable sled for transporting a person, the sled comprising:

a flexible panel comprising a head portion, a foot portion, a first side and a second side, a sled length extending from the head portion to the foot portion, a sled width extending from the first side to the second side, each of the first and second sides extending from the head portion toward the foot portion, the flexible panel being constructed of a wear resistant material for dragging over rough terrain;

sheet portions made of limp material that is less resistant to wear than the material of the flexible panel, the sheet portions being attached to the flexible panel, one of the sheet portions extending laterally outwardly from the first side of the flexible panel and another of the sheet portions extending laterally outwardly from the second side of the flexible panel, each sheet portion including an exterior surface and an interior surface, a portion of the exterior surface facing toward an interior surface of the flexible panel;

the flexible panel and sheet portions being collapsible to a compact configuration and expandable from the compact configuration to a use configuration in which the person may be received on the sled for transporting;

strapping comprising a horizontal lifting strap having a transverse portion extending from the sheet portion on the first side of the flexible panel to the sheet portion on the second side of the flexible panel, no portion of the horizontal strap being located on the exterior surfaces of the sheet portions laterally outward of the flexible panel.

* * * * *